US007648619B2

(12) United States Patent
Chuang et al.

(10) Patent No.: US 7,648,619 B2
(45) Date of Patent: Jan. 19, 2010

(54) HYDROGEL-DRIVEN MICROPUMP

(75) Inventors: Sway Chuang, Pingtung Hsien (TW); Morris Liang, Yunlin Hsien (TW); Frank Fan, Hsinchu (TW); Wae-Honge Chen, Tainan (TW)

(73) Assignee: Industrial Technology Research, Hsinchu (TW)

( * ) Notice: Subject to any disclaimer, the term of this patent is extended or adjusted under 35 U.S.C. 154(b) by 836 days.

(21) Appl. No.: 11/262,266

(22) Filed: Oct. 28, 2005

(65) Prior Publication Data

US 2006/0102483 A1 May 18, 2006

Related U.S. Application Data

(63) Continuation-in-part of application No. 10/162,842, filed on Jun. 4, 2002, now abandoned.

(51) Int. Cl.
*B67D 5/00* (2006.01)

(52) U.S. Cl. ..... 204/600; 417/48

(58) Field of Classification Search ..... 204/450, 204/456, 600, 606; 417/48
See application file for complete search history.

(56) References Cited

U.S. PATENT DOCUMENTS 3,915,172 A * 10/1975 Wichterle et al. ..... 604/8
4,024,073 A * 5/1977 Shimizu et al. ..... 516/102
5,288,214 A * 2/1994 Fukuda et al. ..... 417/395
6,626,417 B2 * 9/2003 Winger et al. ..... 251/129.06

OTHER PUBLICATIONS

Seida et al, Kagaka Kogaku Ronbunshu, 1990, 16(6), pp. 1279-1282.*

* cited by examiner

*Primary Examiner*—Kaj K Olsen
(74) *Attorney, Agent, or Firm*—Pro-Techtor Int'l Services

(57) ABSTRACT

A hydrogel-driven micropump, comprising: two fluid chambers; a fluid channel, connecting the two fluid chambers; a first substrate plate and a second substrate plate, which are glass wafers produced by micromechanical working, each having accommodation chambers which are filled in hydrogel which are placed next to the two fluid chambers and connected by inward extending bridges, with electric terminals leading to the accommodation chambers; a middle substrate, sandwiched between the first and second substrate plates and made by a bulk micromachining process, having separated accommodation chambers close to ends thereof. A separating block is placed between the accommodation chambers. The middle substrate between the first and second substrate plates forms a micropump body. All of the substrates are separated by membranes. The accommodation chambers for electrophoretic fluid are located between the membranes and the first and second substrate plates, respectively, and insulating material. An electrophoretic fluid channel is left between the membranes and the bridges. The fluid channel is placed within the middle substrate between the membranes. The first substrate plate has through holes from outside to the two fluid chambers, allowing fluid to be injected.

20 Claims, 2 Drawing Sheets

HYDROGEL-DRIVEN MICROPUMP

This is a continuation-in-part application of applicant's U.S. patent application Ser. No. 10/162,842 filed on Jun. 4, 2002, since abandoned but published as US 2003/0196900.

BACKGROUND OF THE INVENTION

1. Field of the Invention

The present invention relates to a hydrogel-driven micropump, particularly to a hydrogel-driven micropump.

2. Description of Related Art

A small-scale fluid system mainly comprises a micropump, a microvalve, a flow rate meter, a microchannel, and a fluid mixing device. Using a micromechanical process and technique (MEMS), various small-scale fluid driving chips are produced for applications in biotechnology, for portable environmental detection devices, precise flow control or fluid driving systems, following a tendency to ever smaller dimensions. Micropumps are important components of small-scale fluid systems for driving fluid and have been used in conjunction with micro total analysis systems (μTAS), lab-on-chips, medicine dosers and biochip systems.

For producing micropumps, various novel materials and working techniques have been tried and have led to a large variety of designs, such as electromagnetic, electrostatic, piezoelectric, form-remembering alloy and double-metal micropumps. Table 1 shows properties of these designs.

TABLE 1

| Type | Flow rate (μl/min) | Voltagepower (V) | Consumption (mW) | Maximum pressure (Kpa) |
|---|---|---|---|---|
| piezoelectric | 1300 | 160 | — | 90 |
| piezoelectric | 40 | 100 | — | 15 |
| electrostatic | 850 | 200 | 1 | 31 |
| Warm flow | 34 | 6 | 2000 | 4 |
| electromagnetic | 20 | 3 | 900 | — |
| double metal | 43 | 16 | — | — |
| Memory alloy | 50 | — | 630 | 0.52 |

Each of the various designs for micropumps have shortcomings, such as high working voltage or high power consumption. A high working voltage requires a complicated power supply, which does not fit into a portable device, making control and detection applications hard to implement, so that applications are limited.

SUMMARY OF THE INVENTION

The present invention provides a micropump which works at low voltage and low power consumption and is thus easily combined with any device, following the tendency to low-voltage, low-power, portable devices with a high degree of safety.

The present invention uses expansion and contraction of hydrogel for driving fluid. Volume changes of expanding and contracting hydrogel drive fluid in a chamber via a membrane. Electrophoretic fluid is driven by an electric field, causing hydrogel to expand and shrink. Electrophoresis is a mature technology, used for separating and analyzing substances, like proteins. Originally, to carry out electrophoresis a voltage of several hundred volts was needed. Due to miniaturization, however, which reduces distances between positive and negative terminals, required voltages have been reduced considerably along with reaction times. Thus the present invention works at low voltage and at low power.

Manufacturing of the hydrogel-driven micropump of the present invention is done by a micromechanical working process (MEMS), combining a semiconductor manufacturing process and precise mechanics for producing small structural parts for microsystems. In this disclosure, a micropump is defined as a pump manufactured by MEMS. Employing micromechanical working process has the following advantages: (1) Production of thousands or hundreds of samples on a single chip, reducing production cost; (2) producing tiny and precise components; (3) manufacturing of mechanical and electronic devices being combinable on single chip. All components of micropumps are produced using bulk micromachining, so that combining with microvalves, flow rate meters, microchannels and fluid mixing devices is readily possible.

The hydrogel-driven micropump of the present invention comprises: two fluid chambers; a fluid channel, connecting the two fluid chambers; a first substrate plate and a second substrate plate, which are glass wafers produced by micromechanical working, each having hydrogel accommodation chambers which are placed next to the two fluid chambers and connected by inward extending bridges, with electric terminals leading to the accommodation chambers; a middle substrate, sandwiched between the first and second substrate plates and made by a bulk micromachining process, having separated fluid chambers close to ends thereof. A separating block is placed between the fluid chambers. The middle substrate between the first and second substrate plates forms a micropump body. All of the substrates are separated by membranes. The accommodation chambers for electrophoretic fluid and hydrogel are located between the membranes and the first and second substrate plates, respectively, and insulating material. An electrophoretic fluid channel is left between the membranes and the bridges. The fluid channel is placed within the middle substrate between the membranes. The first substrate plate has an inlet and an outlet, which in one embodiment are through holes from outside to the two fluid chambers, allowing fluid to be injected and ejected.

An important object of the present invention is to provide a hydrogel-driven micropump operating at low voltage and with low power consumption, suitable for portable, safe devices.

Another object of the present invention is to provide a hydrogel-driven micropump operated by expanding and contracting of hydrogel, thereby deforming membranes and thus driving a fluid.

A further object of the present invention is to provide a hydrogel-driven micropump, with hydrogel being expanded and contracted by electrophoresis, wherein applying voltage shifts an electrophoretic fluid, changing liquid absorption of the hydrogel, thus deforming the hydrogel, while operating voltage and power consumption are low.

A further object of the present invention is to provide a hydrogel-driven micropump produced by a micromechanical working process using bulk micromachining for separately manufacturing each component and assembling the components with adding membranes and hydrogel, attaining good system integration.

The present invention can be more fully understood by reference to the following description and accompanying drawings.

DETAILED DESCRIPTION OF THE PREFERRED EMBODIMENT

Hydrogel is a polymeric material having a fine net-like structure and being able quickly to absorb a quantity of liquid of dozens of the original mass. Having absorbed water, hydrogel expands, and after having released water, hydrogel shrinks. Therefore, by varying the quantity of absorbed water, the volume of a piece of hydrogel is changeable. In one embodiment, Hydrogel is made of polyacrylamide-co-acrylic acid. Absorption of water until saturation and subsequent volume change happens very fast. The fastest rate is absorption of a 70-fold mass of water within one minute, accompanied by a volume increase of 100% per second.

Electrophorese usually needs application of several hundred volts for allowing ions to separate by a sufficient distance between electric terminals. For example, for separating hemo-proteins, a distance of several centimeters to several tens of centimeters is required.

When electrophorese is performed, positive ions are by an applied electric field moved towards a negative terminal, taking along molecules of the solvent at the following velocity:

$$v = \frac{\varepsilon \xi E}{4\pi\eta}$$

where ν denotes the velocity of the solution, ∈ denotes the dielectric constant, ξ denotes the electromotive forte, E denotes the electric field strength, and η denotes the coefficient of viscosity of the solution. As above formula shows, the velocity of the solution is proportional to the electric field strength. If the distance between the electric terminals is reduced to several tens of micrometers, being 1/1000 of the distant used for conventional electrophoresis, the required voltage is reduced accordingly to several hundreds of mV, while traveling time of an ion from one terminal to the opposite terminal is reduced from a second to several milliseconds. Increasing of the voltage further reduces the traveling time. The electrophoretic fluid contains phosphate, thus fast expanding of the hydrogel and fast flow of the electrophoretic fluid lead to a high operating frequency of the micropump, so that a high flow rate of over 1000 ml/min is achieved.

Figure 1A:
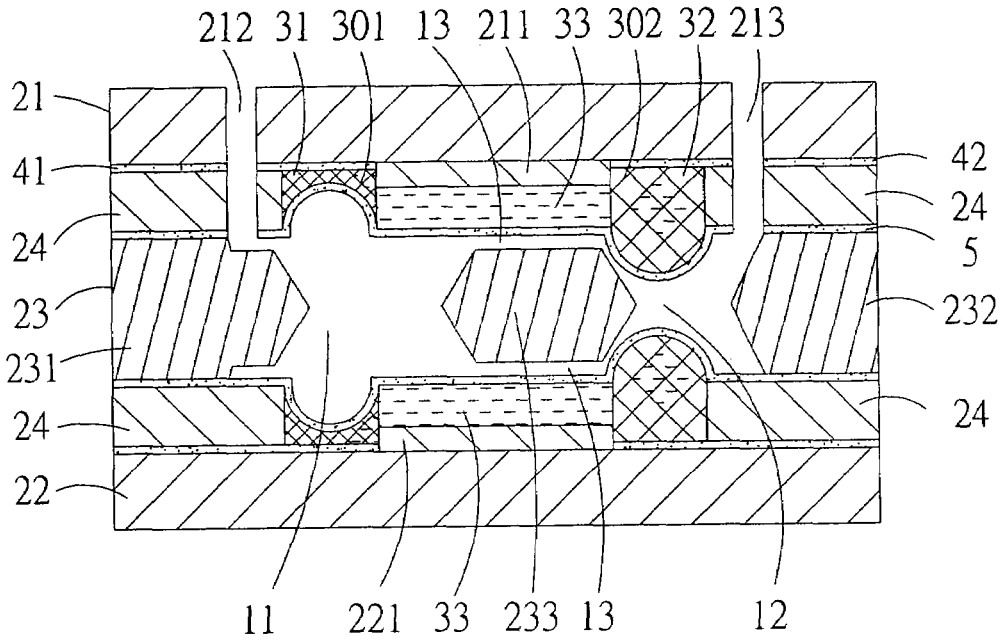
FIGS. 1*a* and 1*b* are schematic illustrations of the hydrogel-driven micropump of the present invention.
Figure 1B:
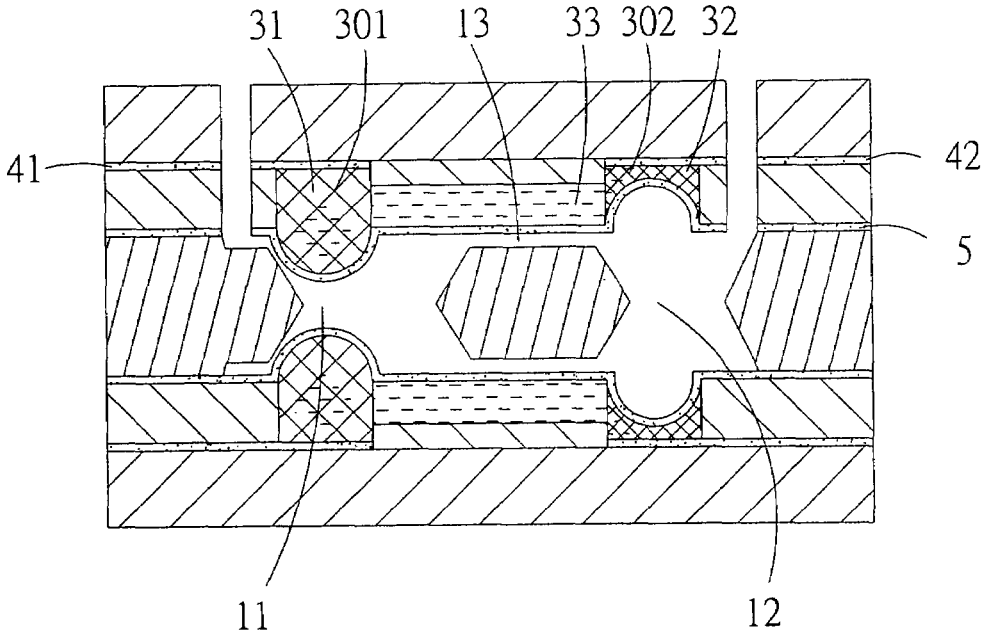

As shown in FIGS. 1*a* and 1*b*, the hydrogel-driven micropump of the present invention mainly comprises: two fluid chambers 11, 12; a fluid channel 13, connecting the two fluid chambers 11, 12; a first substrate plate 21 and a second substrate plate 22, which are glass wafers produced by micromechanical working, each may have accommodation chambers 31, 32 which are placed next to the two fluid chambers 11,12 and connected by inward extending bridges 211, 221, with electric terminals 41, 42 leading to the accommodation chambers 31,32; a middle substrate 23, sandwiched between the first and second substrate plates 21, 22 and made by a semiconductor manufacturing process, having ends 231, 232 located next to the two fluid chambers 11, 12, respectively. A separating block 233 is placed between the two fluid chambers 11, 12. The middle substrate 23 between the first and second substrate plates forms a micropump body in which the substrates are separated by diaphragm membranes 5. The hydrogel accommodation chambers 31, 32 for hydrogel 301, 302 and electrophoretic fluid are located between the membranes 5 and the first and second substrate plates 21, 22, respectively, and insulating material 24. An electrophoretic fluid channel 33 is left between the membranes 5 and the bridges 211, 221. The fluid channel 13 is placed between the membranes 5 and the middle substrate 23. The first substrate 21 plate has through holes 212,213 from outside to the two fluid chambers, allowing fluid to be injected. The insulating material 24 is sediment material, like SiO2 or Si3N4 or photoresist material, like SU8.

More than two fluid chambers are alternatively used, with a fluid channel being located between each two neighboring fluid chambers.

Furthermore, alternatively the lower half of the micropump shown in FIG. 1*a*, consisting of the middle substrate 23, the separating plate 233, the insulating material 24, the electric terminals 41, 42 and the second substrate plate 22 is replaced by a substrate plate having a depression directly accommodating the fluid chambers 11, 12.

The electric terminals 41, 42 are made by platinum galvanization, in one embodiment. In a further embodiment, when a hydrogel of polyacrylamide-co-acrylic acid is used, which absorbs water rapidly and within a short reaction time, Phosphate is employed as electrophoretic fluid. In one embodiment, the membranes 5 are made of flexibility and thermal polymerized silicon acid amide. Silicon has excellent flexibility and biochemical stability, acid amide has good chemical characteristics.

The present invention works by expanding and contracting of hydrogel 301, 302. Volume change of the hydrogel deforms the membranes 5, driving fluid in the fluid chambers 11, 12. Electrophoresis causes electrophoretic fluid to flow to one end of the micropump, varying the quantity of fluid absorbed by hydrogel and causing hydrogel to expand or contract.

As shown in FIG. 1*a*, the hydrogel-driven micropump of the present invention is operated by applying an electric voltage between the electric terminals 41 and 42. With the electric terminal 41 being positively charged and the electric terminal 42 being negatively charged, electrophoretic fluid flows, from the accommodation chamber 31 through the electrophoretic fluid channel 33 into the accommodation chamber 32. Then hydrogel in the accommodation chamber 31 is depleted of fluid and shrinks, while hydrogel in the accommodation chamber 32 is filled with fluid and expands. The membranes 5 consequently deform, with the volume of the fluid chamber 11 being enlarged and the volume of the fluid chamber 12 being reduced, so that fluid is pressed outward outlet through the through hole 213 and sucked inward through the inlet through hole 212.

Referring to FIG. I*b*, after switching polarity, so that the electric terminal 41 is negatively charged and the electric terminal 42 is positively charged, electrophoretic fluid flows from the accommodation chamber 32 through the electrophoretic fluid channel 33 into the accommodation chamber 31. Then hydrogel in the accommodation chamber 32 is depleted of fluid and shrinks, while hydrogel 301 in the accommodation chamber 31 is filled with fluid and expands. The membranes 5 consequently deform, with the volume of the fluid chamber 12 being enlarged and the volume of the fluid chamber 11 being reduced, so that fluid is pressed through the fluid channel 13 into the fluid chamber 12.

After this, the above step of expanding the fluid chamber 11 is repeated, so that fluid is sucked in through the inlet through hole 212. Following this, the fluid chamber 11 shrinks, and the fluid chamber 12 expands, causing fluid to flow from the fluid chamber 11 through the fluid channel 13 into the fluid chamber 12. Then the fluid chamber 12 is contracted, pushing out fluid through the outlet through hole 213.

As above-mentioned, when electrophorese is performed, positive ions located at hydrogel 301 drag water is move toward a negative terminal which located at hydrogel 302 by an applied electric field between 41 & 42. This cause hydrogel 301 &302 to shrink and expand in the same time respectively. The fluid chamber 11 will expand and suction liquid, and the fluid chamber 12 will shrink and pump liquid out to 213 as FIG. 1*a*.

Electrophoreses phenomenon will happen in the hydrogels 301, 302 and fluid channel 33. Electrophoretic flow will continue, but the flow direction depends on the applied electric field. Electrophoretic flow direction changes due to the converted electric field in the next cycle as FIG. 1*b*.

The present invention allows for bi-directional flow of fluid. By installing microvalves and blocking valves, bi-directional operation is achieved. Adding of other structural parts, like microdetectors or microtubes generates a complete microsystem.

Figure 2A:
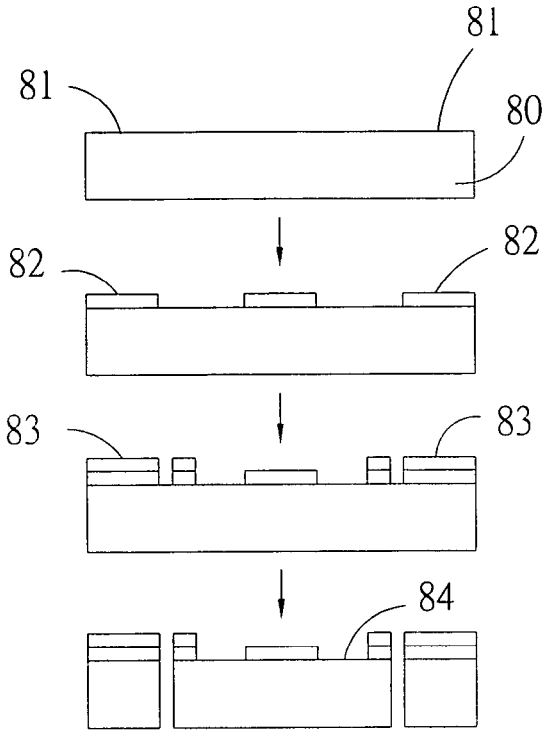
FIGS. 2*a* and 2*b* are schematic illustrations of the bulk micromachining process for producing the hydrogel-driven micropump of the present invention.

A micromachining process combines a semiconductor manufacturing process with micromechanical working for manufacturing complete Microsystems. Bulk micromachining has already been widely used. The hydrogel-driven micropump of the present invention is manufactured by bulk micromachining. As shown in FIG. 2*a*, manufacturing of the first and second substrate plates 21, 22 comprises the following steps:

1. Coating two ends of a glass wafer 80 with separated platinum layers 81 to serve as electric terminals.
2. Placing a photoresist layer of SU8 on the glass wafer 80 to form a first photoresist layer 82.
3. Placing a photoresist layer of SU8 on the first insulating layer 82 to form a second photoresist layer inside containing the accommodating spaces for hydrogel.
4. Putting a $SiO_2$ membrane 84 on top and boring through holes.

Figure 2B:
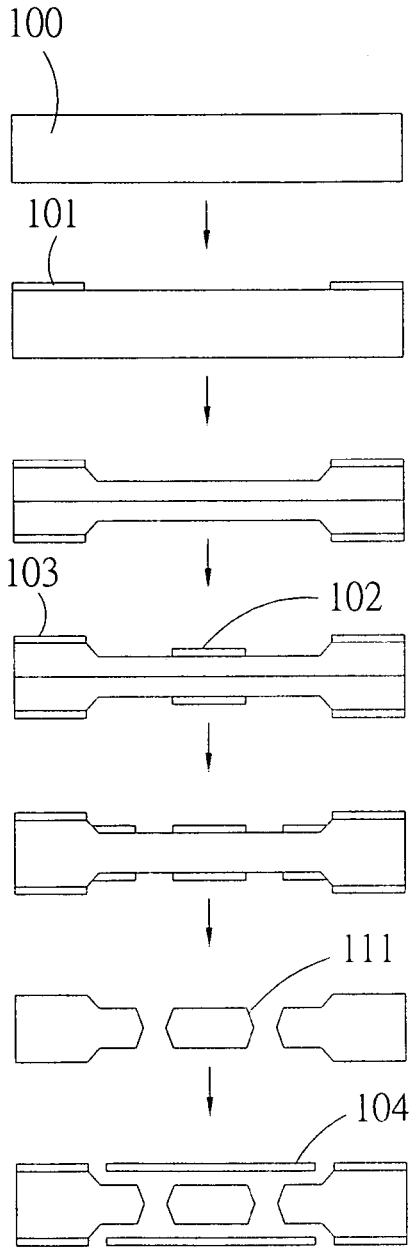

As shown in FIG. 2*b*, manufacturing of the micropump body comprises the following steps:

1. Taking a (100)-cut Si wafer as a base.
2. Placing $SiN_2$ layers 101 on two ends of the Si wafer to form etching openings.
3. Using basic fluid, performing anisotropic etching down to a preset depth.
4. Placing a $SiN_2$ layer 102 on a middle section of the Si wafer.
5. Coating the two ends of the Si wafer with $SiN_2$ layers 103.
6. Using basic fluid, performing anisotropic etching of holes and (111)-inclinations in the Si wafer.
7. Putting a $SiO_2$ membrane 104 on top, forming fluid chambers.

While the invention herein disclosed has been described by means of specific embodiments, numerous modifications and variations could be made thereto by those skilled in the art without departing from the scope and spirit of the invention set forth in the claims.

The invention claimed is:

1. A hydrogel-driven micropump, comprising:

two fluid chambers; a fluid channel, connecting said two fluid chambers;

a first substrate plate and a second substrate plate each having accommodation chambers filled in hydrogel which are placed next to said two fluid chambers and connected by inward extending bridges, and with electric terminals leading to said accommodation chambers; and a middle substrate, sandwiched between said first and second substrate plates and having separated fluid chambers close to ends thereof, with a separating block being placed between said fluid chambers;

wherein said middle substrate between said first and second substrate plates forms a micropump body, all of said substrates are separated by membranes, said fluid chambers are located between said membranes and said first and second substrate plates, respectively, and insulating material, an electrophoretic fluid channel is left between said membranes and said bridges, said fluid channel is placed within said middle substrate between said membranes, and said first substrate plate has through holes from outside to said two fluid chambers allowing fluid to be injected.

2. A hydrogel-driven micropump according to claim 1, wherein said micropump body is manufactured by a bulk micromachining process.

3. A hydrogel-driven micropump according to claim 1, wherein said first and second substrate plates are glass wafers manufactured by a bulk micromachining process.

4. A hydrogel-driven micropump according to claim 1, wherein said middle substrate is a silicon wafer manufactured by a bulk micromachining process.

5. A hydrogel-driven micropump according to claim 1, wherein said membranes are made of silicon and polymerized poly-acidamide.

6. A hydrogel-driven micropump according to claim 1, wherein said electric terminals are made of platinum.

7. A hydrogel-driven micropump according to claim 1, wherein electrophoretic fluid containing phosphate is used.

8. A hydrogel-driven micropump according to claim 1, wherein hydrogel made of polyacrylamide-co-acrylic acid is used.

9. A hydrogel-driven micropump according to claim 1, wherein expansion and contraction of said hydrogel is brought about by electrophoresis, with an electrophoretic fluid by an electric field being driven between two ends, causing said hydrogel to change absorption of said electrophoretic fluid and consequently to expand or contract.

10. A hydrogel-driven micropump according to claim 9, wherein applied voltage is not larger than 10 V.

11. A hydrogel-driven micropump according to claim 9, wherein said electrophoretic fluid contains phosphate.

12. A hydrogel-driven micropump according to claim 1, wherein said first and second substrate plates are glass plates manufactured by a bulk micromachining process.

13. A hydrogel-driven micropump according to claim 1, wherein said middle substrate is a silicon wafer manufactured by a bulk micromachining process.

14. A hydrogel-driven micropump according to claim 1, wherein between said first and second substrate plates chambers for hydrogel and eletrophoretic fluid are formed.

15. A hydrogel-driven micropump according to claim 1, wherein for said middle substrate, said separating block, said insulating material, said electric terminals and said second substrate plate a substrate plate having a depression is substituted.

16. A hydrogel-driven micropump, comprising:

a fluid inlet; a fluid outlet; at least one micropump body having:

a planar middle substrate having at least one first fluid chamber in fluidic communication with said fluid inlet and at least one second fluid chamber in fluidic communication with said fluid outlet, a separating block being placed between said at least one first fluid chamber and at least one second fluid chamber with a fluid channel providing fluidic communication therebetween, a first insulating material layer and a second insulating material layer, each having a first hydrogel chamber and a second hydrogel chamber containing hydrogel and fluidically interconnected by an electrophoretic fluid channel, with a first electric terminal leading to said first hydrogel chamber and a second electric terminal leading to said second hydrogel chamber, said middle substrate sandwiched between said first and second insulating layers with said first and said second hydrogel chambers positioned adjacent said first fluid chamber and said second fluid chamber respectively; and an electrophoretic fluid disposed in said electrophoretic fluid channel and absorbed ion the hydrogel;

wherein said middle substrate, and said first and second insulating layers are separated by membranes, whereby alternately applying a positive and a negative voltage to said first and second terminals causes the electrophoretic fluid to be shuttled between said first and second hydrogel chambers and a resulting expansion and contraction of said hydrogel causes fluid to be injected and ejected from said micropump.

17. A hydrogel-driven micropump according to claim 16, further comprising a first substrate plate and a second substrate plate, which are glass plates produced by micromechanical working, and are positioned on opposite sides of said middle substrate with the insulating layers and membranes sandwiched therebetween; wherein expansion and contraction of said hydrogel is brought about by electrophoresis, with an electrophoretic fluid being driven by an electric field between the accommodation chambers causing said hydrogel to change absorption of said electrophoretic fluid and to expand or contract.

18. A hydrogel-driven micropump according to claim 17, wherein applied voltage is not larger than 10 V.

19. A hydrogel-driven micropump according to claim 17, wherein said electrophoretic fluid contains phosphate.

20. A hydrogel-driven micropump according to claim 16, wherein said hydrogel is made of polyacrylamide-co-acrylic acid.

* * * * *